United States Patent [19]

Pichon

[11] Patent Number: 4,557,353

[45] Date of Patent: Dec. 10, 1985

[54] SERVICE ELEVATOR FOR CONSTRUCTION

[76] Inventor: Michel A. Pichon, 24 Rue Wilson, 69150 Décines, France

[21] Appl. No.: 493,743

[22] Filed: May 11, 1983

[30] Foreign Application Priority Data

May 11, 1982 [FR] France ..... 82 08740

[51] Int. Cl.[4] ..... B66B 9/00; B66B 9/20

[52] U.S. Cl. ..... 187/2; 187/9 R; 187/6; 187/95; 182/178

[58] Field of Search ..... 187/2, 9 R, 95, 6; 52/731, 254, 732, 730; 182/178; D25/61; 403/312, 313, 314, 300, 338, 408, 13, 14

[56] References Cited

U.S. PATENT DOCUMENTS

| | | | |
|---|---|---|---|
| 498,859 | 6/1893 | Poulson | 52/731 |
| 1,552,474 | 9/1925 | Dornier | 52/731 |
| 3,820,906 | 6/1974 | Katt | 403/312 |
| 3,878,916 | 4/1975 | White, Jr. | 187/2 |
| 4,040,694 | 8/1977 | Lascarrou | 403/408 |
| 4,248,025 | 2/1981 | Kleine et al. | 52/731 |
| 4,262,773 | 4/1981 | Basham | 187/9 R |

*Primary Examiner*—Joseph J. Rolla
*Assistant Examiner*—Andrew Jones
*Attorney, Agent, or Firm*—Karl F. Ross; Herbert Dubno

[57] ABSTRACT

A construction elevator has a mast formed from sheet steel panels and bolted together through rows of holes along longitudinal edges of the mast which are provided with flanges also having such holes. The rails for guiding the cabin are likewise provided with flanges and are bolted in place with the same bolts.

9 Claims, 8 Drawing Figures

FIG. 3
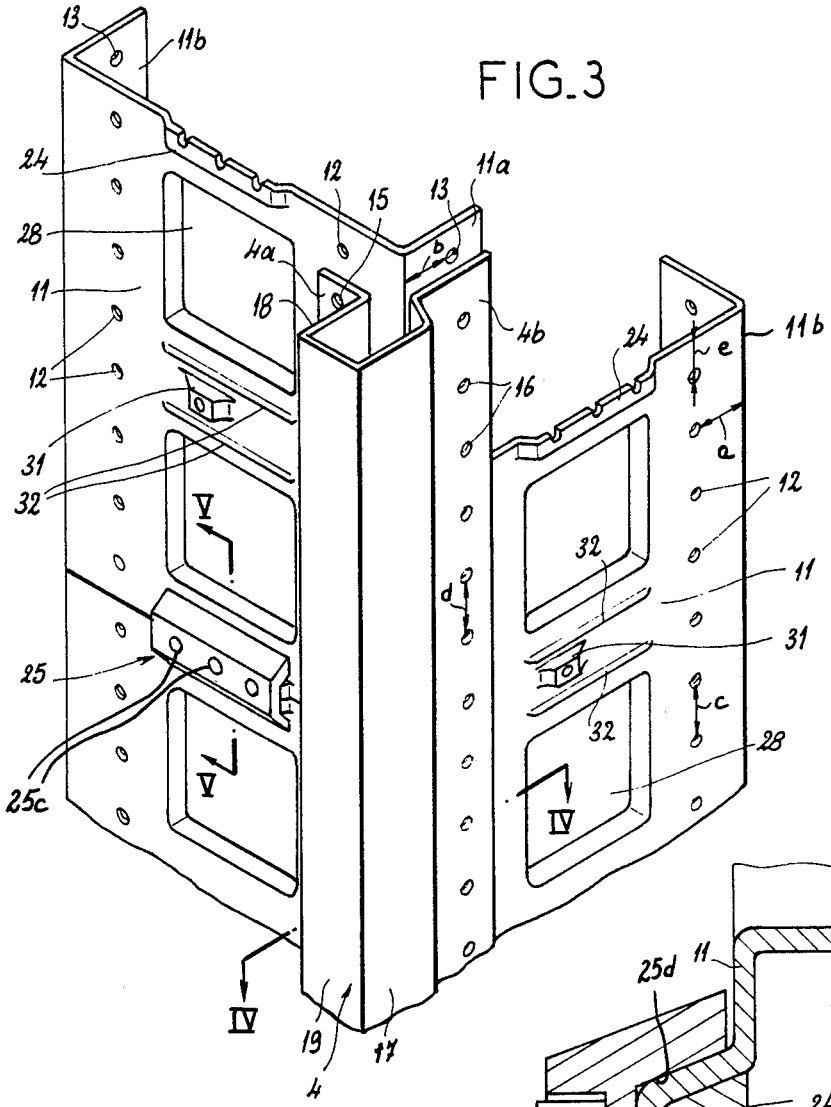
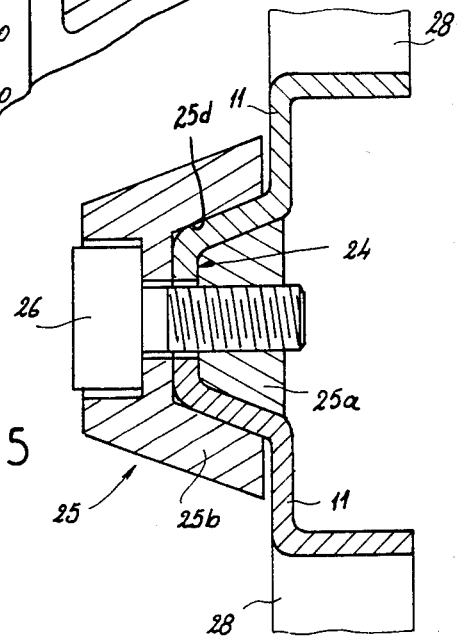
FIG. 5

SERVICE ELEVATOR FOR CONSTRUCTION

FIELD OF THE INVENTION

My present invention relates to a construction elevator of the type adapted to be moored to a structure and, more particularly, to an improved mast construction for such an elevator.

BACKGROUND OF THE INVENTION

It is known to provide, along the face of a building to be renovated or at a construction site at which a building or other structure is to be erected, a so-called construction or service elevator which generally comprises a mast moored to the side of the building and having a pair of rails on which a cabin is guided by respective rollers, the cabin being raised and lowered by a hoist mechanism or a rack and pinion arrangement.

Such elevators can deliver building materials at the various levels, can be used as personnel transporters and can even be employed to remove construction detritus from the various levels.

In earlier elevator constructions of this type, the mast is assembled by stacking a number of units, each of which may form the mast at a respective level and consists of tubular elements welded together. The rail forming members are generally rectangular-section tubes also welded in place on these units.

Means is provided at the bottom of one such unit and the top of an underlying unit to connect the two units together and interfitting formations are provided on the rail pieces to assure proper alignment.

Not only are such structures expensive because complete preformed units for each level of the mast are required, but they frequently lack the desired stability because between vertically adjoining units, weak zones are formed over the full cross section of the mast and may fail if, for some reason, the connections are inadequate or are subject to fatigue.

Furthermore, if one of the units is found to be defective in manufacture as it is hoisted into place, significant problems with assembly ensue and a correction may not be simple or may result in weakening of the entire structure.

Problems are also encountered because of the need to have interfitting tenon-like connections between the tubular members forming the rails.

OBJECTS OF THE INVENTION

It is, therefore, the principal object of the present invention to provide an improved mast structure for an elevator of the type described whereby these disadvantages are overcome.

Another object of my invention is to provide an improved construction elevator with which assembly is simplified, stability is ensured and the fabrication cost is minimal.

SUMMARY OF THE INVENTION

These objects and others which will become apparent hereinafter are attained, in accordance with the present invention in a construction elevator for the purposes described in which the mast is assembled from sheet steel panels, at least most of which can be of identical construction and which are of rectangular outline and are formed with flanges at their longitudinal edges overlapping with similar panels, the panels having rows of bores or openings where they overlap to enable them to be joined by bolting through the register openings.

Along one face of the mast which results, at least a pair of rails can be formed for engagement by rollers of a cabin. According to the invention, moreover, the upper and lower borders of contiguous panels join at staggered junctions along the different faces of the mast so that a single junction plane is not provided at any level between all of the panels of the particular level and the corresponding panels of an adjoining level.

Thus by staggering the junctions from one side to another side around the mast, an extremely stiff mast structure can be ensured.

According to a perfect embodiment of the invention all of the panels are substantially identical and the rails are formed from channels having flanges which likewise are provided with rows of holes registering with the holes of the panels and their respective flanges and disposed at a right angle corner formed between two such panels. In this case, the holes of the rails can have the same distribution and spacing as those of the panels and the same bolts which secure the panels together at the respective corner can be utilized to fix the rails in place.

According to another embodiment of the invention, the rails themselves are formed unitarily with panels which are to form the face of the mast along which the cabin is guided and these panels are secured to the angularly adjoining panels by bolts through the aligned holes of respective rows of uniformly spaced holes. In this case, for a rectangular-section mast, three faces of the latter are formed by identical panels while the fourth face along which the cabin is guided is constituted by the panels unitarily provided with the rails.

The panels can be stamped with bosses facilitating attachment of the rack or other accessories with transverse ribs for reinforcement and at their upper and lower edges or borders with angles which form channels with the corresponding angle of the contiguous panel. These channels are secured together by bridles.

For proper alignment and to limit the possibility of relative shifting of the panels, each panel, angle or flange, where it is provided with a hole, is stamped with a frustoconical boss surrounding the hole and forming a countersink into which a similar boss of an adjoining panel or flange can project.

Windows or the like can be provided to reduce the weight and material usage of the panels and generally will be aligned with flanges for stiffening purposes.

In addition, the rails can have trapezoidal-section channels whose flanks can form the guide surfaces as desired.

BRIEF DESCRIPTION OF THE DRAWING

The above and other objects, features and advantages of the present invention will become more readily apparent from the following description, reference being made to the accompanying drawing in which:

FIG. 3 is a partial perspective view of one of the corners of the mast showing the guide rail in somewhat greater detail;

FIG. 5 is a sectional view along the line V—V of FIG. 3 showing a preferred mode of assembling the upper and lower borders of two of the mast panels together;

SPECIFIC DESCRIPTION

Figure 1:
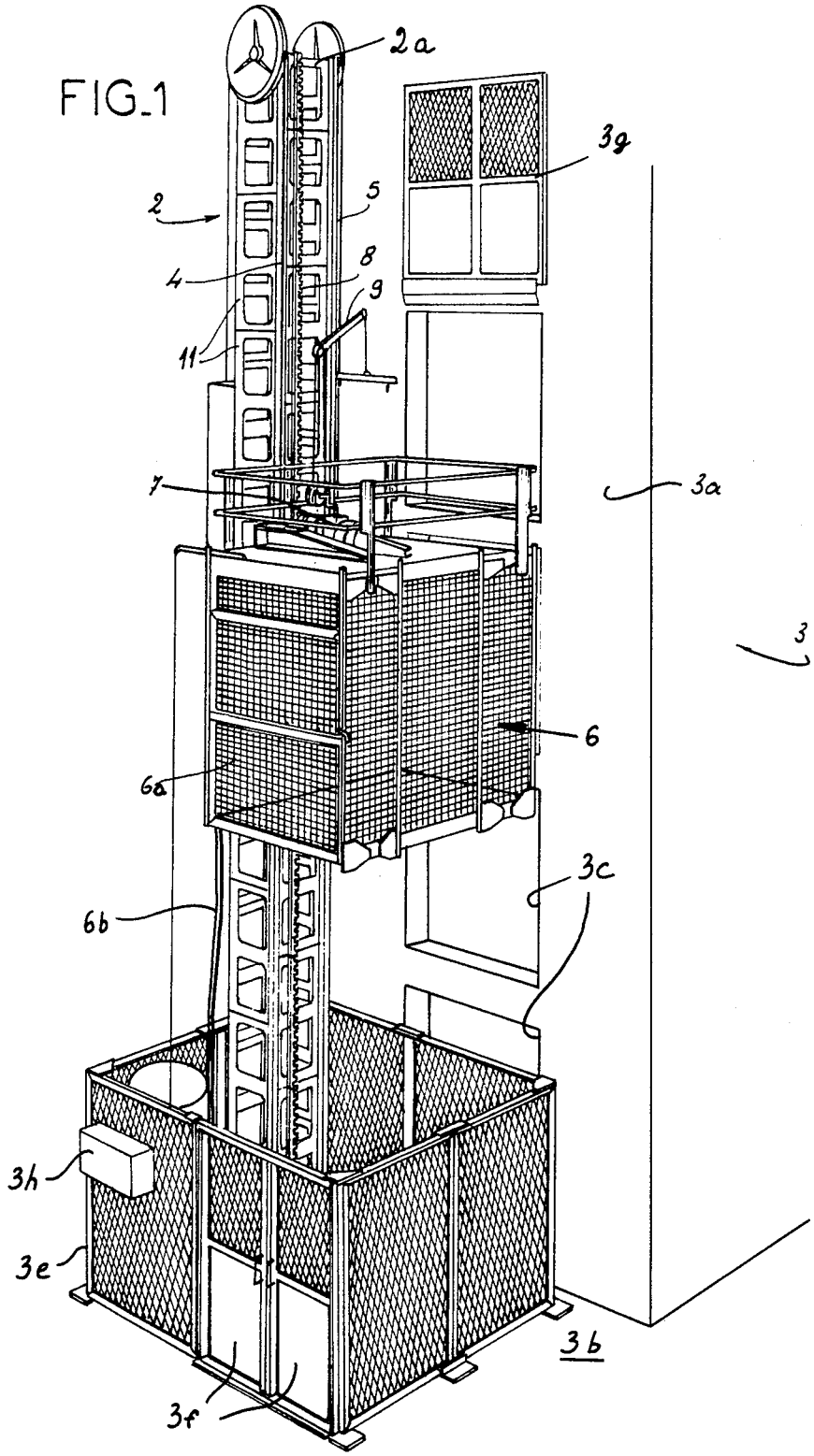
FIG. 1 is a diagrammatic perspective view of the construction elevator of the present invention alongside a building under construction and shown only in outline form.

As can be seen from FIG. 1, a construction elevator adapted to be disposed along the face 3*a* of a building 3 undergoing construction or renovation can comprise a mast 2 of square cross section rising from the ground 3*b* and anchored or moored to the face 3*a* of the building which can have openings 3*c* forming windows or doorways into which construction material can be loaded through which personnel riding the elevator can gain access to the interior and from which construction detritus can be removed.

The lower portion of the mast may be surrounded by a cage 3*e* which can have a door 3*f* affording access to the riding cage or cabin 6 which can have a vertical displaceable door 6*a* aligned with the door 3*f* when the cabin is in a lowered position. The opposite side of the cabin may be open to the windows 3*c* or may be provided with a door (not shown) which can be aligned with doors 3*g* at selected levels or at each level for safety reasons. An electrical supply and control box 3*h* may be provided on the lower cage and can be connected to the cabin by a cable or the like as shown at 6*b* to supply electrical energy to the motor of the latter.

The mast 2 has two angles or edges represented generally at 4 and 5 and defining a pair of guide rails along one lateral face of the mast, these rails being engageable by upper and lower sets of rollers not visible in FIG. 1 and serving to mount the cabin and guide it vertically along the mast with a minimum of play.

The cabin 6 which is displaceable along the face 2*a* of the mast vertically, can have an electric motor 7 controlled from the box 3*h* and/or from within the cabin and connected to a pinion not visible in FIG. 1, meshing with the rack 8 extending the length of the mast. Instead of a rack and pinion drive, of course, any conventional lifting mechanism may be used including chains or cables connected to the cabin and passing over wheels or sprockets at the top of the mast or affixed thereto when the drive is carried by the cabin. Alternatively, the drive motor may be provided at the base of the mast and connected to the cabin by such chains and cables. These variations from the best mode structure illustrated utilize systems conventional in the art.

The cabin 6 also is provided with a jib-type crane 9 which can reach over the top of the existing portion of the mast when the cabin is in an upper position to lift additional mast parts into place thereby allowing the height of the mast to be increased. The crane can also be utilized to transfer materials necessary for construction and for disassembling the mast when construction is completed.

Figure 2:
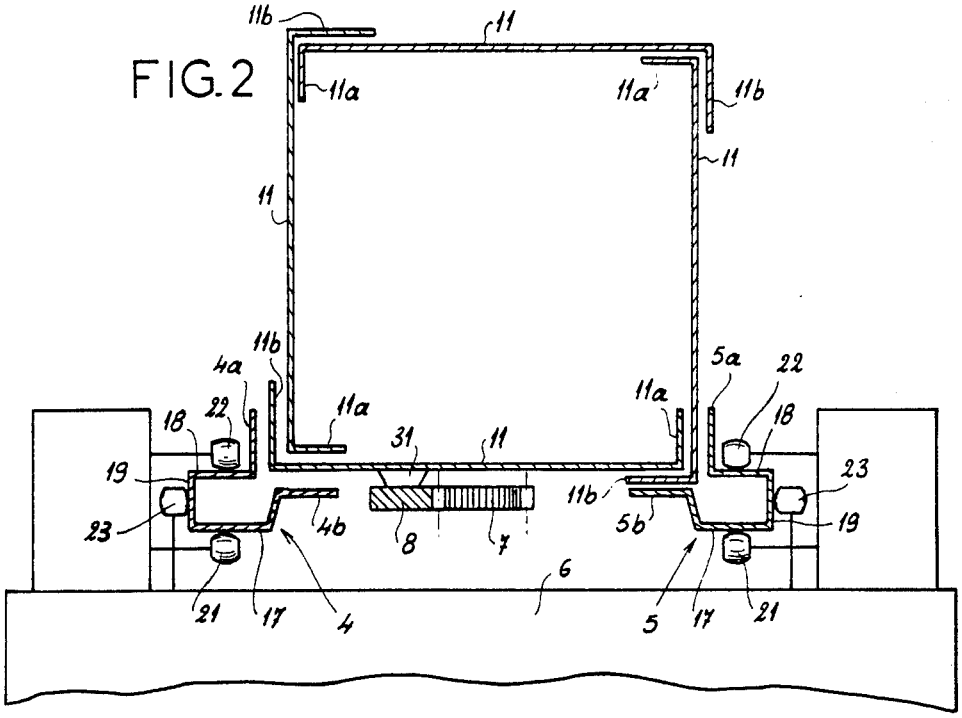
FIG. 2 is a cross section through the mast of this elevator, also in diagrammatic form and drawn to a significantly larger scale than that of FIG. 1.
Figure 4:
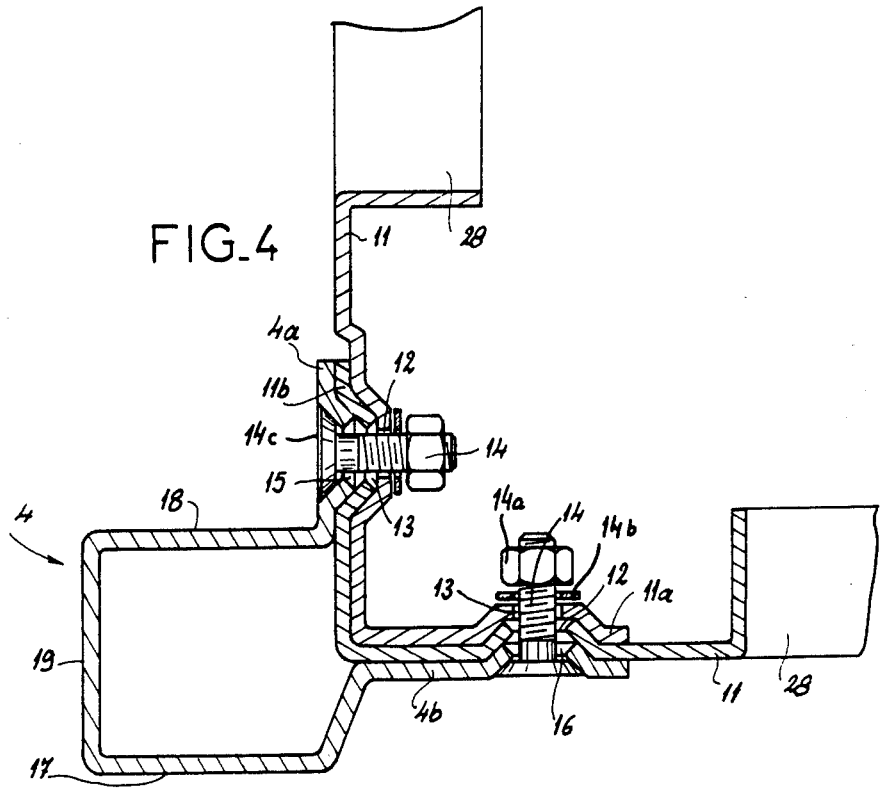
FIG. 4 is a sectional view taken along the line IV—IV of FIG. 3 showing to still a larger scale the construction of a rail and its attachment to the panels.

As is also clear from FIGS. 2 and 3, where the various bolts utilized to secure the elements together have not been shown and hence the elements are illustrated as spaced apart for greater clarity, and from FIGS. 4 and 5 in which the bolts are illustrated, the mast is composed by an assembly of sheet steel panels generally represented at 11 and all of which can be identical to one another so that all of the panels around the periphery of the mast and over the height thereof are interchangeable.

Each of the panels 11 is provided with a pair of flanges 11*a* and 11*b* along the respective longitudinal edges, at 90° to the web connecting these flanges. As will be apparent from FIG. 3, at equal spacing from a corner 11*b* which will form an edge of the rectangular cross section mast, each panel is provided with a row of holes 12 along the respective web and with a row of holes 13 along the respective flange. The holes of each row are also equispaced and the spacing of the rows of holes are identical as well.

Thus, as can be seen from FIG. 3, each hole 12 is located at a distance a from the respective corner while each hole 13 is located at a distance b from the respectiv corner, the holes 12 are spaced apart by a distance c, the holes 13 are spaced apart by a distance d and, at each edge of the panel, the first hole of each row is spaced from the respective edge by a distance e. Preferably $a=b$, $c=d$ and $e=c/2=d/2$.

As can be seen from FIGS. 2 and 3 as well, the flange of one panel is positioned to overhang the web and receive the flange of an adjacent panel at one corner and to be itself received within the angle of the adjacent panel at an opposite corner. As a consequence, a truly square cross section of the mast with all of the panels adjoined at right angles at each level, can be assured.

Furthermore, the panels are vertically staggered with respect to one another around the periphery of the mast. Thus, if the lower edge of one panel can be constituted to lie at a lower level, the panels adjacent this lower level panel can have their lower edges raised say half the height of a panel with respect to the first, and hence the adjacent panels can be considered to be vertically staggered.

As a consequence, there is no single plan of separation between vertical sections at which all of the panels of a given horizontal level adjoining one another and which may constitute a weakening.

In the preferred embodiment of the invention represented in FIGS. 2–4, the rails 4 and 5 of the mast are constituted by sheet steel profiles which have a pair of flanges 4*a* and 4*b* or 5*a* and 5*b* lying at right angles to one another, adapted to overlie the flanges or webs of a panel forming the lateral face along which the cabin can ride, and having rows of holes 15 and 26 with the same spacing c and d so that the holes of these flanges can be aligned with the holes of the web of a panel and with a flange of another panel overlying or underlying the latter web so that bolts 14 can be inserted through the registering holes and secured thereagainst by nuts 14*a* and lock washers 14*b*. The holes may all be formed with countersinks which interfit as shown in FIG. 4 and which receive the head 14*c* of the bolts.

In addition, the rails 4 and 5 are each formed with a rectangular structure defined by a pair of flanks 17 and 18 which project parallel to the latter face along which the cabin can ride, and a flank 19 perpendicular to the flanks 17 and 18, and therefore perpendicular to the plane of the face along which the cabin rides.

Each flank 17 is engaged by a roller 21 (FIG. 2) at the upper and lower parts of the cable 6, each flank 18 is engaged by an opposite roller 22 and each flank 23 is engaged by still another roller so that the rollers 23 are juxtaposed with one another and prevent transverse movement parallel to this plane of the mast whereas the rollers 21 and 22 prevent movement of the cabin toward and away from the mast. The frustoconical countersinks, by nesting together, also prevent play within the elements of the mast.

Each panel 11 is provided along its upper and lower borders with a stamped portion 24 in the form of an angle or, more accurately form of a channel half to enable the contiguous pairs to be attached together one above the other or one below another by bridles 25 having male and female portions **25*a* and 25*b*. The female portions 25*a* are bars as can be seen from FIG. 3 provided with openings 25*c* registering with holes defined by the angles 24 and enabling screws or bolts 26 to be threaded into the male member 25*b* received with the channel. Since the channel formed by the angles 24 has inwardly divergent flanks (trapezoidal cross section), the recess 25*d*** of the female member is of complementary shape and the outer configuration of the male member is of complementary shape to the inner cavity of this channel.

Figure 6:
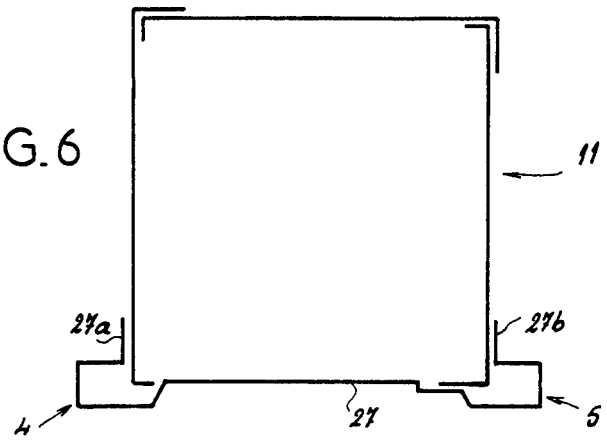
FIG. 6 is a diagram representing in plan view another embodiment of the invention.
Figure 7:
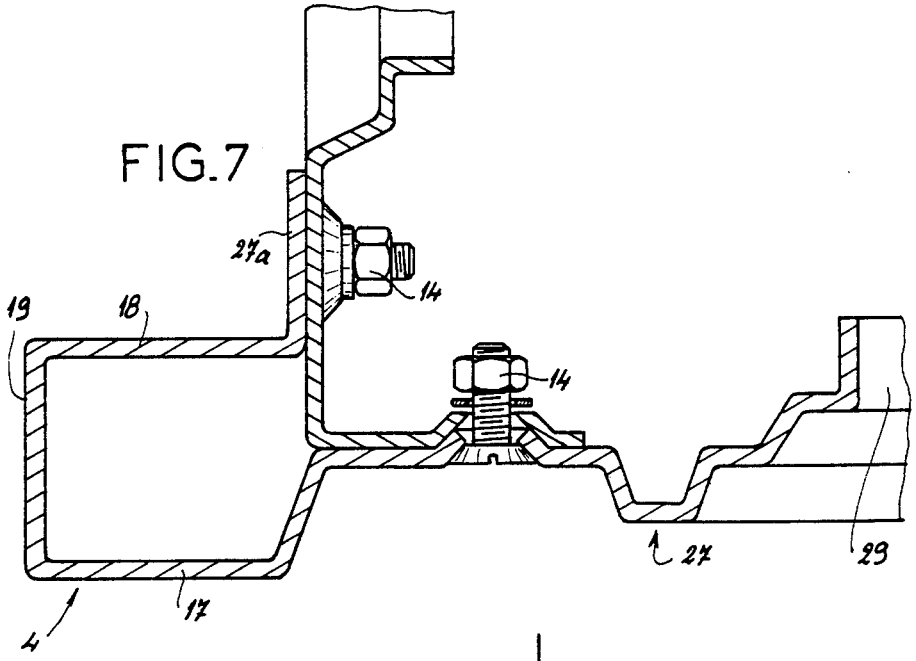
FIG. 7 is a view similar to FIG. 4 showing the attachment of a rail at one of the corners of a mast constructed in accordance with the embodiment of FIG. 6.

FIGS. 6 and 7 show a modification of this construction. In this embodiment, two rails are formed unitarily in a rolling or pressing portion from a panel 27. In this case, the longitudinal borders are rolled with the rails 4 and 5 which can otherwise have the described and illustrated configuration in connection with FIGS. 1–5. The panel 27 ends in a pair of flanges **27*a* and 27*b* provided with rows of holes in the manner previously described which can be aligned with the rows of holes of the webs of adjoining panels and bolted to them. Inwardly of the rails 4 and 5, the web of the panel 27** may be provided with rows of holes which are also bolted to flanges of the adjoining panels.

The bolting assembly has been shown in greater detail in FIG. 7. The embodiment of FIGS. 6 and 7 has the advantage that the number of pieces which have to be assembled is reduced at the expense of providing special panels 27 which can differ from the other panels of the assembly.

As in the embodiment previously described, where holes are formed in the panels, they are stamped with frustoconical forms which interfit to assist in alignment and prevent play.

Figure 8:
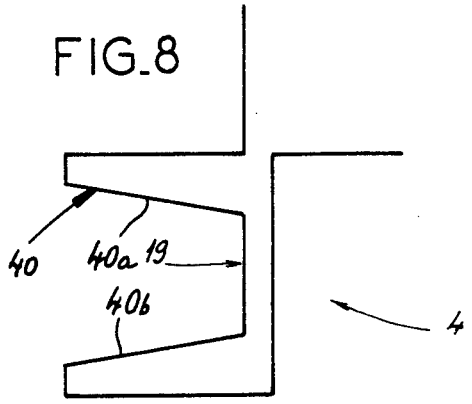
FIG. 8 is an outline diagram of the type of FIG. 6 but showing another guide rail according to the invention.

FIG. 8 diagrammatically represents a modification in which the rails 4 and 5, for greater security of guidance can be laterly indented so that the flank 19 lies at the root of a trapezoidal-section channel and can receive a complementarily shaped roller (not shown). In this embodiment, the frustoconical channel 40 provides not only the flank 19 as a lateral guide flank, but also flanks **40*a* and 40*b* which engage the roller or respective rollers and serve to prevent movement of the cabin toward and away from the mast, i.e. fulfill the functions of the flanks 17 and 18**.

As can be seen from FIGS. 1, 3, 4, 5 and 7 moreover, the panels 11 and 27 can be made somewhat lighter and also strengthened, while reducing their cost by providing them with windows 28 and 29 which are stamped in the panels and have inwardly bent portions framing these windows.

In addition, each panel can be provided with one or more bosses 31 which can be utilized to attach the rack or any other device which need be applied. Stiffening ribs, transverse ribs 32, can flank the boss 31 or may be provided wherever necessary and also are stamped during the stamping of the panels.

I claim:

1. A construction elevator having a mast adapted to be secured to a structure, a cabin displaceable along a face of said mast, and means for displacing said cabin along said mast, said mast comprising:

an assembly of sheet metal panels of rectangular outline having flanges along longitudinal edges and provided along said flanges and proximal to said flanges with rows of equispaced holes alignable with the holes of adjoining panels whereby four such panels can be joined at right angles to define a rectangular cross section of said mast and said panels along each side of the rectangular cross section have contiguous borders;

bolts traversing holes of angularly adjoining panels for securing them together; and a pair of rails extending along said face and secured to said mast by said bolts whereby said bolts simultaneously secure said rails to said panels, said rails are formed unitarily on panels disposed along said face of said mast.

2. The construction elevator defined in claim 1 wherein each of said rails is provided with a pair of flanges and each of said flanges is formed with a row of holes and adapted to overlie adjoining sides of said mast and to be bolted to the respective panels and flanges through registering holes of the flanges of said rails and the panels and flanges thereof, holes of said panels and said flanges having the same spacing in respective rows thereof.

3. The construction elevator defined in claim 1 wherein the panels along all four sides of the mast are identical.

4. The construction elevator defined in claim 1 wherein said panels are formed with windows to reduce the weight thereof.

5. The construction elevator defined in claim 1 wherein the upper and lower borders of said panels have angles contiguously defining respective channels, said mast further comprising a bridle having a male member received in the respective channel, a female member receiving the respective channel and bolts clamping said male and female members together.

6. The construction elevator defined in claim 1 wherein said panels have bosses, said mast further comprising a rack affixed to said boss and forming the means for displacing said cabin.

7. The construction elevator defined in claim 6, further comprising transverse ribs stamped in said panels for stiffening same.

8. The construction elevator defined in claim 1 wherein said holes are formed with stamped frustoconical projections interfitting where said holes register with one another and are traversed by said bolts.

9. The construction elevator defined in claim 1 wherein said rails are formed with frustconical channels having flanks which engage with rollers of said cabin.

* * * * *